US006109495A

United States Patent [19]

Hernandez

[11] Patent Number: 6,109,495

[45] Date of Patent: Aug. 29, 2000

[54] BACKPACK WITH INFLATABLE POCKETS

[76] Inventor: Gwendolyn Hernandez, 845-E. 24th St., Paterson, N.J. 07513

[21] Appl. No.: 09/199,105

[22] Filed: Nov. 25, 1998

[51] Int. Cl.[7] ..... A45F 3/04

[52] U.S. Cl. ..... 224/644; 224/652; 224/264

[58] Field of Search ..... 224/907, 264, 224/627, 642, 643, 644, 652, 683, 684, 653, 681; 190/109, 111

[56] References Cited

U.S. PATENT DOCUMENTS

| | | | |
|---|---|---|---|
| 3,321,120 | 5/1967 | Cunningham | 224/653 |
| 3,679,108 | 7/1972 | Ingram | 224/644 |
| 4,324,012 | 4/1982 | Cannaday | 224/644 X |
| 4,830,245 | 5/1989 | Arakaki | 224/907 X |
| 5,031,246 | 7/1991 | Kronenberger | 2/413 X |
| 5,228,609 | 7/1993 | Gregory | 224/907 X |
| 5,361,957 | 11/1994 | Weintraub | 224/264 |
| 5,547,461 | 8/1996 | Levis | 224/644 X |

FOREIGN PATENT DOCUMENTS

| | | | |
|---|---|---|---|
| 2264502 | 11/1975 | France | 224/209 |
| 2406402 | 6/1979 | France | 224/264 |
| 2662341 | 11/1991 | France | 224/213 |
| 2754061 | 6/1979 | Germany | 224/209 |
| 94028756 A2 | 12/1944 | WIPO | 224/264 |

*Primary Examiner*—Gregory M. Vidovich

[57] ABSTRACT

A backpack with inflatable pockets for reducing shoulder and back fatigue when carrying a load. The backpack with inflatable pockets includes a housing with front and back portions, a pair of side portions, top and bottom portions, and an interior that is defined by the portions. The housing has an opening into the interior of the housing. A pair of elongate carrying straps each have opposite first and second ends. The first end of each of the carrying straps is coupled to the back portion of the housing towards the top portion of the housing. The second ends of the carrying straps are coupled to the back portion of the housing. An inflatable air pillow is coupled to the back portion of the housing towards the bottom portion of the housing. Each of the carrying straps may also have an inflatable cavity disposed therein.

1 Claim, 2 Drawing Sheets

31
30
33
34
35
37
36

49
43
44
45
22
46
40
42
41

BACKPACK WITH INFLATABLE POCKETS

BACKGROUND OF THE INVENTION

1. Field of the Invention

The present invention relates to backpacks and more particularly pertains to a new backpack with inflatable pockets for reducing shoulder and back fatigue when carrying a load.

2. Description of the Prior Art

The use of backpacks is known in the prior art. More specifically, backpacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,883,053; U.S. Pat. No. 4,561,578; U.S. Pat. No. 5,012,964; U.S. Pat. No. 5,626,507; U.S. Pat. No. 3,347,429; and U.S. Pat. No. Des. 373,227.

While these devices fulfill their respective, particular objectives and requirements, the aforementioned patents do not disclose a new backpack with inflatable pockets. The inventive device includes a housing with front and back portions, a pair of side portions, top and bottom portions, and an interior that is defined by the portions. The housing has an opening into the interior of the housing. A pair of elongate carrying straps each have opposite first and second ends. The first end of each of the carrying straps is coupled to the back portion of the housing towards the top portion of the housing. The second ends of the carrying straps are coupled to the back portion of the housing. An inflatable air pillow is coupled to the back portion of the housing towards the bottom portion of the housing. Each of the carrying straps may also have an inflatable cavity disposed therein.

In these respects, the backpack with inflatable pockets according to the present invention substantially departs from the conventional concepts and designs of the prior art, and in so doing provides an apparatus primarily developed for the purpose of reducing shoulder and back fatigue when carrying a load.

SUMMARY OF THE INVENTION

In view of the foregoing disadvantages inherent in the known types of backpacks now present in the prior art, the present invention provides a new backpack with inflatable pockets construction wherein the same can be utilized for reducing shoulder and back fatigue when carrying a load.

The general purpose of the present invention, which will be described subsequently in greater detail, is to provide a new backpack with inflatable pockets apparatus and method which has many of the advantages of the backpacks mentioned heretofore and many novel features that result in a new backpack with inflatable pockets which is not anticipated, rendered obvious, suggested, or even implied by any of the prior art backpacks, either alone or in any combination thereof.

To attain this, the present invention generally comprises a housing with front and back portions, a pair of side portions, top and bottom portions, and an interior that is defined by the portions. The housing has an opening into the interior of the housing. A pair of elongate carrying straps each have opposite first and second ends. The first end of each of the carrying straps is coupled to the back portion of the housing towards the top portion of the housing. The second ends of the carrying straps are coupled to the back portion of the housing. An inflatable air pillow is coupled to the back portion of the housing towards the bottom portion of the housing. Each of the carrying straps may also have an inflatable cavity disposed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new backpack with inflatable pockets apparatus and method which has many of the advantages of the backpacks mentioned heretofore and many novel features that result in a new backpack with inflatable pockets which is not anticipated, rendered obvious, suggested, or even implied by any of the prior art backpacks, either alone or in any combination thereof.

It is another object of the present invention to provide a new backpack with inflatable pockets which may be easily and efficiently manufactured and marketed.

It is a further object of the present invention to provide a new backpack with inflatable pockets which is of a durable and reliable construction.

An even further object of the present invention is to provide a new backpack with inflatable pockets which is susceptible of a low cost of manufacture with regard to both materials and labor, and which accordingly is then susceptible of low prices of sale to the consuming public, thereby making such backpack with inflatable pockets economically available to the buying public.

Still yet another object of the present invention is to provide a new backpack with inflatable pockets which provides in the apparatuses and methods of the prior art some of the advantages thereof, while simultaneously overcoming some of the disadvantages normally associated therewith.

Still another object of the present invention is to provide a new backpack with inflatable pockets for reducing shoulder and back fatigue when carrying a load.

Yet another object of the present invention is to provide a new backpack with inflatable pockets which includes a housing with front and back portions, a pair of side portions, top and bottom portions, and an interior that is defined by the portions. The housing has an opening into the interior of the housing. A pair of elongate carrying straps each have opposite first and second ends. The first end of each of the carrying straps is coupled to the back portion of the housing towards the top portion of the housing. The second ends of the carrying straps are coupled to the back portion of the housing. An inflatable air pillow is coupled to the back portion of the housing towards the bottom portion of the housing. Each of the carrying straps may also have an inflatable cavity disposed therein.

Still yet another object of the present invention is to provide a new backpack with inflatable pockets that has hand pumps attached to it so that the pockets may be inflated by hand without the need for special tools.

Even still another object of the present invention is to provide a new backpack with inflatable pockets that overcomes the problem of shoulder straps digging into a wearer's shoulders when carrying a heavy load, as is common with traditional backpacks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
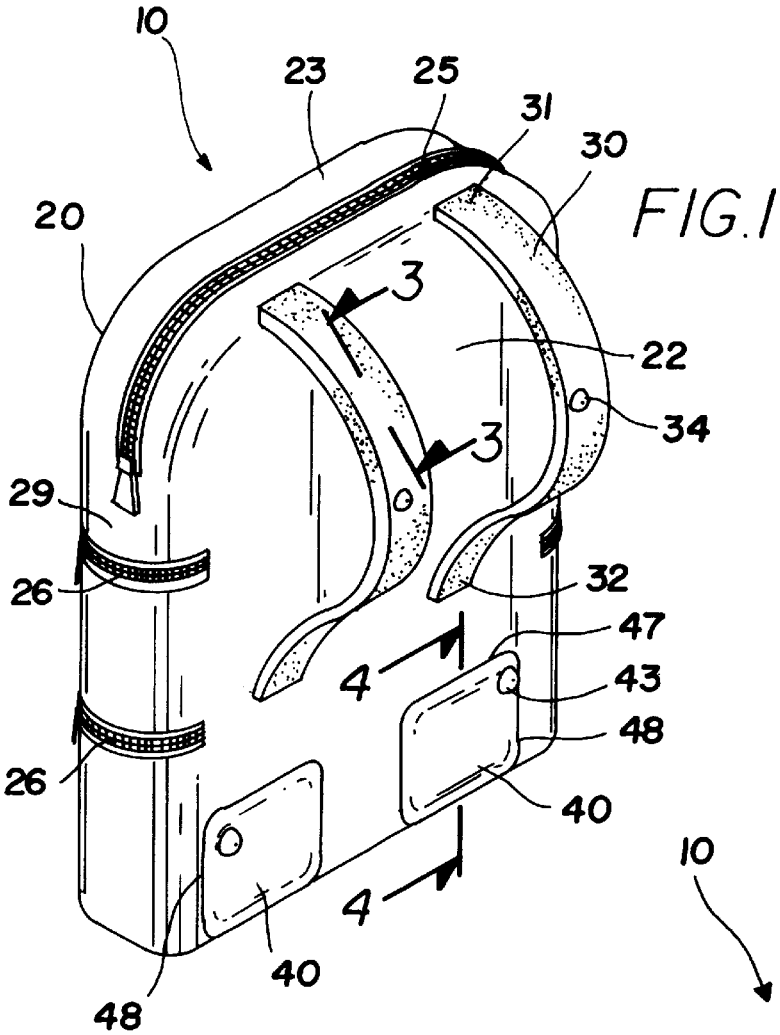
FIG. 1 is a schematic perspective view of a new backpack with inflatable pockets according to the present invention.
Figure 2:
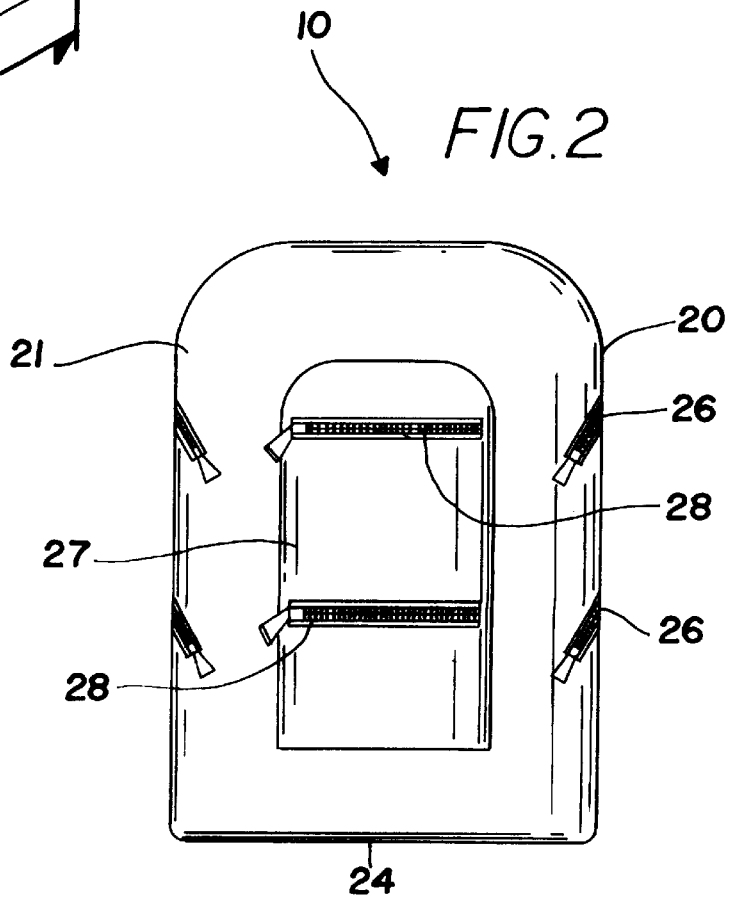
FIG. 2 is a schematic side view of the present invention.
Figure 3:
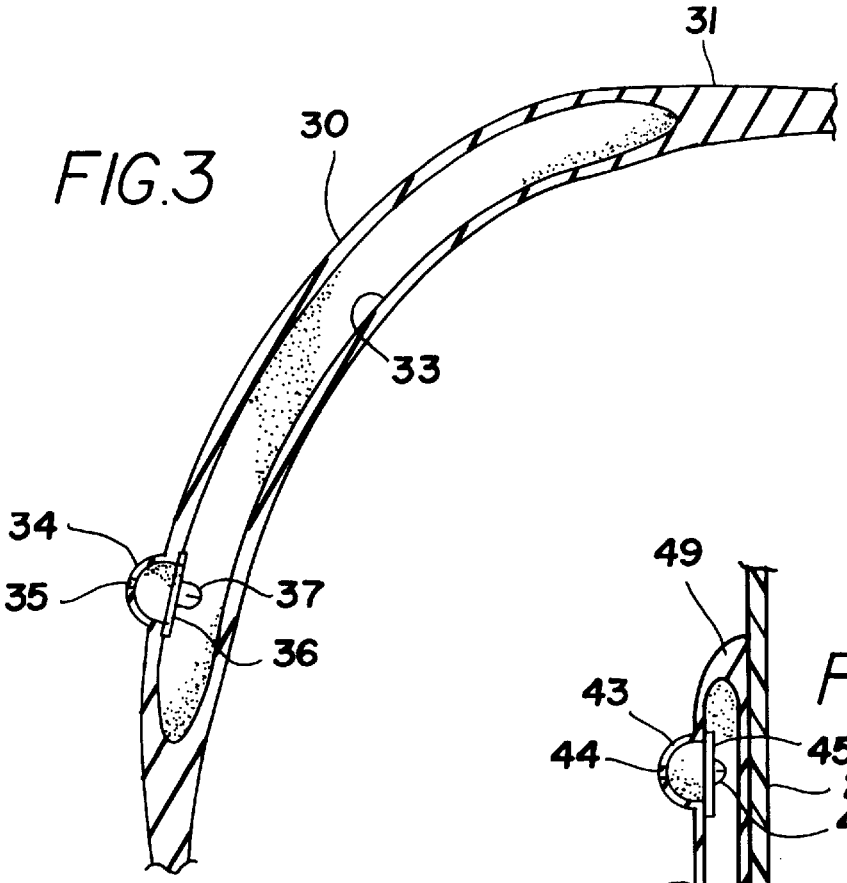
FIG. 3 is a schematic cross-sectional view of the present invention taken from line 3—3 of FIG. 1.

With reference now to the drawings, and in particular to FIGS. 1 through 4 thereof, a new backpack with inflatable pockets embodying the principles and concepts of the present invention and generally designated by the reference numeral 10 will be described.

As best illustrated in FIGS. 1 through 4, the backpack with inflatable pockets 10 generally comprises a housing 20 with front and back portions 21,22, a pair of side portions 29, top and bottom portions 23,24, and an interior that is defined by the portions of the housing 20. The housing 20 has an opening 25 into the interior of the housing 20. A pair of elongate carrying straps 30 each have opposite first and second ends 31,32. The first end 31 of each of the carrying straps 30 is coupled to the back portion 22 of the housing 20 towards the top portion 23 of the housing 20. The second ends 32 of the carrying straps 30 are coupled to the back portion 22 of the housing 20. An air pillow 40 is coupled to the back portion 22 of the housing 20 towards the bottom portion 24 of the housing 20.

Preferably, the top portion 23 of the housing 20 has a zippered opening 25 extending therealong between the side portions 29 that defines an opening into the interior of the housing 20. The carrying straps 30 are adapted to receive the arms of a user therethrough. Each of the carrying straps 30 has opposite first and second ends 31,32. Ideally, the second ends 32 of the carrying straps 30 are adjustably coupled to the back portion 22 of the housing 20 such as by a clip (not shown) of a type known in the art.

Preferably, as shown in FIG. 1, a pair of generally rectangular air pillows 40 are coupled to the back portion 22 of the housing 20 towards the bottom portion 24 of the housing 20. Ideally, the second ends 32 of the carrying straps 30 are positioned between the air pillows 40 and the first ends 31 of the carrying straps 30.

More preferably, each of the air pillows 40 has an inner panel 41 and a deformable outer panel 42 that form an air pocket therebetween. The inner panel 41 is coupled to the housing 20. Looking to FIGS. 1 and 4, it is seen that each of the outer panels 42 of the air pillows 40 has a deformable generally hemispherical pump portion 43 extending outwardly from it. Pump chambers are defined by each of the pump portions 43 and are in communication with the air pocket of a respective air pillow 40. An outer tip of each of the pump portions 43 has an aperture 44 through it which provides an opening into the pump chamber. Each of the outer panels 42 of the air pillows 40 has a deformable generally circular pump panel 45 coupled to an inner surface thereof for closing the pump chamber.

Ideally, each of the pump panels 45 has a valve portion 46. The valve portion 46 is closed when the pump panel 45 is planar. The valve portion 46 is open when the pump panel 45 is deformed. This permits deflation of the air pillows 40 by squeezing the pump portion 43 to deform the pump panel 45 and open the valve portion 46.

Preferably, each of the outer panels 42 of the air pillows 40 has an upper edge 47 that faces towards the top end of the housing 20 and an outer edge 48 that faces towards an adjacent side portion of the housing 20. Ideally, each of the pump portions 43 of the air pillows 40 is positioned towards a corner of the associated outer panel 42 formed at an intersection of the upper and outer edges 48 of the outer panel 42. This placement is preferred because it permits a user to access the pump portions 43 while he or she wears the backpack 10.

Figure 4:
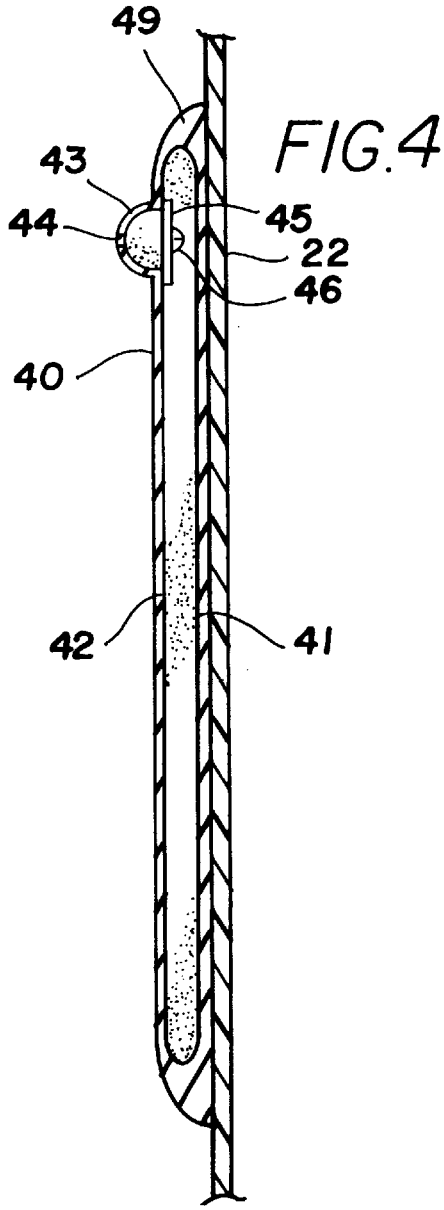
FIG. 4 is a schematic cross-sectional view of the present invention taken from line 4—4 of FIG. 1.

Also preferably, the peripheral sidewall 49 of each of the air pillows 40 tapers towards an outer edge 48 of the inner panel 41 of the air pillow 40 along an arc that curves towards the inner panel 41 of the air pillow 40. This smooth tapering prevents the air pillow 40 from catching on clothing. The rounded shape, shown in FIG. 4, is also designed for comfort when inflated or deflated in that bulging is minimal near the peripheral sidewall 49 when the air pillows 40 are deflated. Also, this tapering of the peripheral sidewall 49 helps hold the front panels of the air pillows 40 taught so that they don't bulge excessively in the center.

Preferably, each of the carrying straps 30 has a substantially airtight cavity 33 therein that receives a quantity of air. Each of the carrying straps 30 has a generally hemispherical pump portion 34 that extends outwardly therefrom and defines a pump chamber that is in communication with the cavity 33 of a respective carrying strap 30. An outer tip of each of the pump portions 34 has an aperture 35 therethrough for providing an opening into the pump chamber. Each of the carrying straps 30 has a pump panel 36 coupled to an inner surface thereof to close the pump chamber.

Each of the pump panels 36 has a valve portion 37. The valve portion 37 is closed when the pump panel 36 is planar. The valve portion 37 is open when the pump panel 36 is deformed. This permits deflation of the air pillows 40 by squeezing the pump portion 34 to deform the pump panel 36 and open the valve portion 37.

A middle section of each of the carrying straps 30 is positioned about midway between the first and second ends 31,32 of each of the carrying straps 30. Preferably, each of the pump portions 34 of the carrying straps 30 is positioned on the middle section of the associated carrying strap 30. This placement is preferred because it permits easiest access to the pump portions 34 for inflating or deflating the cavities 33 of the carrying straps 30. Also preferably, each of the pump portions 34 is positioned on a left side of the associated carrying strap 30 relative to a user viewing the back portion 22 of the housing 20. When the backpack 10 is worn, the pump portion 34 will be easier to grasp by a right-handed person wearing the backpack 10 because the pump portion 34 will be positioned towards the right arm of the user. Preferably, each of the cavities 33 extends between the first end 31 and the middle section of the associated carrying strap 30.

In an exemplary embodiment, each of the side portions 29 of the housing 20 has a pair of pockets of a type known in the art that extend from an inner surface of the side portion and a pair of zippered slots 26 that provide openings into the pockets. The front portion 21 of the housing 20 has a storage flap 27 coupled to it. A divider flap (not shown) extends between the middle of the storage flap 27 and the front portion 21. The storage flap 27, the divider flap, and the front portion 21 of the housing 20 form a pair of storage compartments. The storage flap 27 has a pair of zippered slits 28 providing openings into the storage compartments.

In use, a load is placed in the interior of the housing 20 through the zippered opening 25 of the top portion 23 of the housing 20. A finger is placed over the aperture 35 of the pump portion 34 of a carrying strap 30 and the pump portion 34 of the carrying strap 30 is pushed to collapse the pump chamber of the pump portion 34 of the carrying strap 30. Air is pushed into the cavity 33 of the carrying strap 30, inflating it. The finger is removed and the process is repeated until the desired amount of air is inserted in the cavity 33. The same procedure is followed to inflate the other carrying strap 30. The same general procedure is followed to inflate each of the air pillows 40. The cavities 33 of the carrying straps 30 are deflated by squeezing the pump portion 34 of each of the carrying straps 30 to deform the pump panel 36 and open the valve portion 37. The air pockets of the air pillows 40 are also deflated by squeezing the pump portion 43 of each of the air pillows 40 to deform the pump panel 45 and open the valve portion 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A backpack, comprising:

a housing having front and back portions, a pair of side portions, top and bottom portions, and an interior being defined by said portions;

said top portion of said housing having a zippered opening extending therealong between said side portions and defining an opening into said interior of said housing;

a pair of elongate carrying straps adapted for receiving arms of a user therethrough, each of said carrying straps having opposite first and second ends, said first ends of said carrying straps being coupled to said back portion of said housing towards said top portion of said housing, said second ends of said carrying straps being adjustably coupled to said back portion of said housing;

a first pair of generally rectangular air pillows being coupled to said back portion of said housing towards said bottom portion of said housing such that said second ends of said carrying straps are positioned between said air pillows and said first ends of said carrying straps, said first pair of air pillows being laterally spaced on said back portion and each of the first pair of air pillows being mounted adjacent to one of the side portions of said housing such that each of the air pillows on said back portion are adapted to apply pressure to the back of the wearer on opposite sides of the spine of the wearer such that pressure is not applied directly to the spine;

a second pair of air pillows being incorporated in said pair of elongate carrying straps, each of the second pair of said air pillows being formed in one of said pair of elongate carrying straps at a portion of said carrying strap towards the first end of said carrying strap for resting against a top of a shoulder of the wearer of the housing such that a weight of the housing is applied to the top of the shoulders through said second pair of air pillows;

each of said first pairs of air pillows having an inner panel and a deformable outer panel forming an air pocket therebetween, said inner panel being coupled to said housing;

each of said outer panels of said first pairs of said air pillows having a deformable generally hemispherical pump portion extending outwardly therefrom and defining a pump chamber being in communication with said air pocket of a respective air pillow, an outer tip of each of said pump portions having an aperture therethrough for providing an opening into said pump chamber;

each of said outer panels of said first pair of said air pillows having a deformable generally circular pump panel coupled to an inner surface thereof for closing said pump chamber;

each of said pump panels having a valve portion, said valve portion being closed when said pump panel is planar, said valve portion being open when said pump panel is deformed;

wherein each of said outer panels of said first pair of said air pillows has an upper edge facing towards said top portion of said housing and an outer edge facing towards an adjacent side portion of said housing, wherein each of said pump portions of said air pillows is positioned towards a corner of the associated outer panel formed at an intersection of said upper and outer edges of said outer panel;

said peripheral sidewall of each of said first pair of said air pillows tapering towards an outer edge of said inner panel of said air pillow along an arc curving towards said inner panel of said air pillow;

the second pair of air pillows of each of said carrying straps forming a substantially airtight cavity therein for receiving a quantity of air;

each of said carrying straps having a generally hemispherical pump portion extending outwardly therefrom and defining a pump chamber being in communication with said cavity of a respective carrying strap, an outer tip of each of said pump portions having an aperture therethrough for providing an opening into said pump chamber;

each of said carrying straps having a pump panel coupled to an inner surface thereof for closing said pump chamber;

each of said pump panels associated with said carrying straps having a valve portion, said valve portion being closed when said pump panel is planar, said valve portion being open when said pump panel is deformed;

wherein a middle section of each of said carrying straps is positioned about midway between said first and second ends of each of said carrying straps, wherein each of said pump portions of said carrying straps is positioned on the middle section of the associated carrying strap;

wherein each of said second pair of said air pockets extends between said first end and said middle section of the associated carrying strap;

each of said side portions of said housing having a pair of pockets extending from an inner surface thereof and a pair of zippered slots providing openings into said pockets; and said front portion of said housing having a storage flap coupled thereto, a divider flap extending between said storage flap and said front portion, wherein said storage flap, said divider flap, and said front portion of said housing form a pair of storage compartments, said storage flap having a pair of zippered slits proving openings into said storage compartments;

wherein the air pockets of the first pair of air pockets have a space therebetween;

wherein the air pockets of the first pair of air pockets are elongated in a lateral direction of the housing.

* * * * *